US005614700A

United States Patent [19]

Moss et al.

[11] Patent Number: 5,614,700

[45] Date of Patent: Mar. 25, 1997

[54] INTEGRATING ACCELEROMETER CAPABLE OF SENSING OFF-AXIS INPUTS

[75] Inventors: James R. Moss, Satellite Beach, Fla.; Michael W. Malesko, Ann Arbor; Steven J. Anderson, Willis, both of Mich.

[73] Assignee: Automotive Systems Laboratory, Inc., Farmington Hills, Mich.

[21] Appl. No.: 320,893

[22] Filed: Oct. 11, 1994

[51] Int. Cl.[6] ..... H01H 35/14

[52] U.S. Cl. ..... 200/61.45 M; 200/61.53

[58] Field of Search ..... 200/61.45 R–61.45 M

[56] References Cited

U.S. PATENT DOCUMENTS

| | | | |
|---|---|---|---|
| 3,774,128 | 11/1973 | Orlando | 335/81 |
| 5,012,050 | 4/1991 | Sewell | 200/61.45 R |
| 5,028,750 | 7/1991 | Spies et al. | 200/61.45 M |
| 5,149,925 | 9/1992 | Behr et al. | 200/61.45 M |

*Primary Examiner*—Michael L. Gellner

*Assistant Examiner*—Michael A. Friedhofer

*Attorney, Agent, or Firm*—Lyman R. Lyon, P.C.

[57] ABSTRACT

An accelerometer (10) features a housing (12) having an passage (14) of rectangular cross-section formed therein, the width dimension of which gradually increases with increasing displacement along a central longitudinal axis (16) away from a first end (24) of the passage; and a puck-shaped magnetic sensing mass (26) located within the passage whose magnetic axis extends in a direction normal to the basal surface (18) of the passage. A pair of magnetically-permeable elements (22) on the housing magnetically-interact with the sensing mass so as to bias the sensing mass towards a first position within the passage; and a first and second pair of stationary beam contacts (30) project into the passage so as to be bridged by respective electrically-conductive circumferential surfaces (28) on the sensing mass when it moves to a second position within the passage. A pair of electrically-conductive nonmagnetic plates (32) on the housing magnetically interact with the sensing mass to damp the movement thereof within the passage. A pair of horizontally-wound coils (36,38) provide both test and reconfiguration functions.

21 Claims, 1 Drawing Sheet

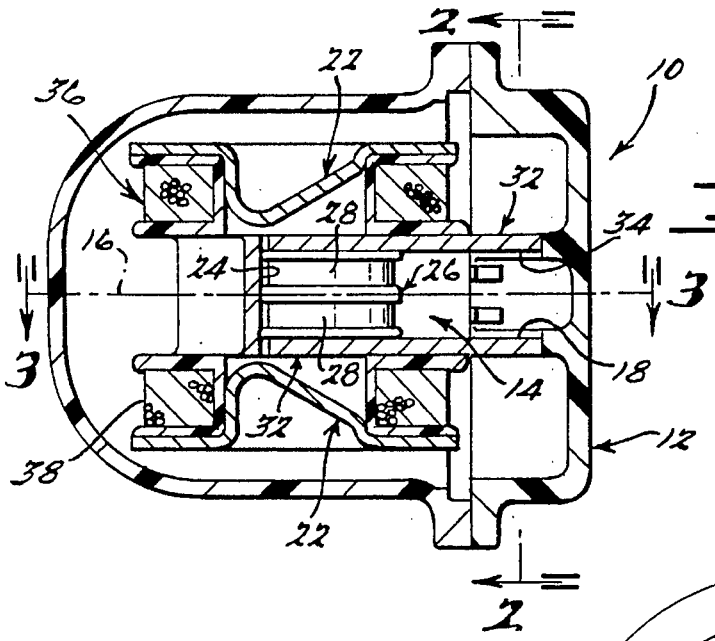
FIG. 1.
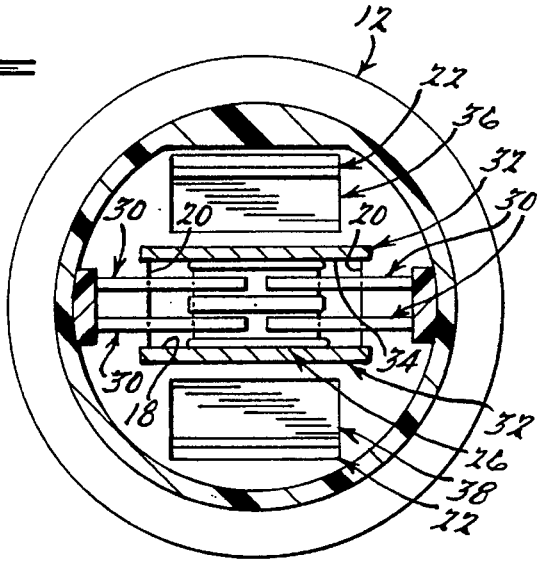
FIG. 2.
FIG. 3.
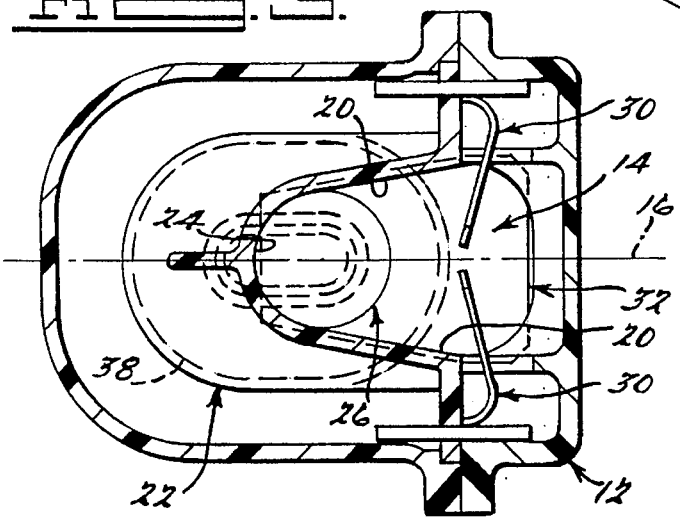
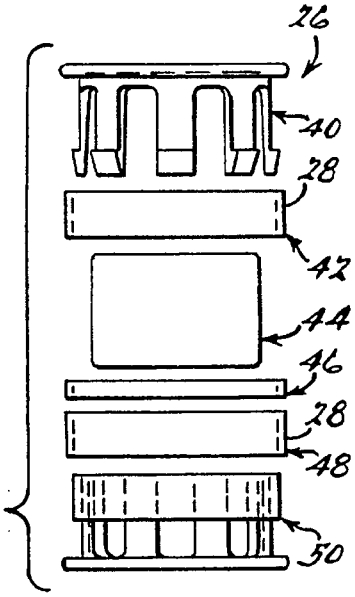
FIG. 4.

INTEGRATING ACCELEROMETER CAPABLE OF SENSING OFF-AXIS INPUTS

BACKGROUND OF THE INVENTION

The instant invention relates to acceleration sensors having an inertial or "sensing" mass which moves in response to acceleration from a first position within a passage to a second position therein so as to physically bridge a pair of beam contacts cantilevered into the passage upon reaching the second position therein.

Known accelerometers used to control actuation of vehicle passenger safety restraints typically comprise a housing having a cylindrical passage formed therein; a spherical or cylindrical sensing mass located within the passage; a means for providing a return bias on the sensing mass, i.e., for nominally biasing the sensing mass to a first position within the passage; and a switch means mounted on the housing so as to be operated by the sensing mass when it moves in response to an acceleration input from its first position within the passage to a second position therein. Such accelerometers are typically of the "integrating" variety, i.e., the movement of the sensing mass within the passage is retarded through the use of friction damping, fluid damping or magnetic damping. See, e.g., U.S. Pat. No. 4,329,549 to Breed (gas damping through use of ball moving in closely-toleranced tube); U. S. Pat. No. 4,827,091 to Behr (magnetic damping through use of a magnetic sensing mass in combination with encompassing conductive, nonmagnetic rings).

Such known accelerometers work well when experiencing acceleration inputs which are coincident with the sensing axis thereof, i.e., the axis of the cylinder defining the passage in which the sensing mass moves. Thus, where the sensing axis of the accelerometer is aligned with the longitudinal axis of a motor vehicle, the accelerometer is most useful in detecting a "head-on" impact.

Correlatively, however, such known accelerometers are less suitable for use in detecting so-called "off-axis" impacts. Specifically, when the vehicle experiences an acceleration input along an impact axis which forms an impact angle $\theta$ relative to the accelerometer's sensing axis, the resultant force acting on the accelerometer's sensing mass along the sensing axis is significantly reduced, with an attendant reduction in the degree of passenger protection afforded by a restraint system controlled by the accelerometer. Stated another way, the accelerating force $A_x$ exerted on the mass in an off-axis impact is merely a component of the applied accelerating force A as projected upon the sensing axis, with a further retarding frictional load F which is itself proportional to the normal reaction component N of the applied accelerating force A. The effect may be summarized using the following equation:

$$\frac{A_x}{A} = \cos\theta - \mu\sin\theta$$

Thus, for a given acceleration input A applied to the vehicle at a relative impact angle $\theta$ of, say, thirty degrees (i.e., where the acceleration input is applied thirty degrees off of the sensing axis of the accelerometer) and a coefficient of sliding friction $\mu$ of 0.20, the resulting acceleration force $A_x$ exerted upon the mass is only 76.6 percent of the applied acceleration input A. The end result is an effective increase in the triggering threshold of the accelerometer in the event the vehicle experiences off-axis acceleration inputs, with a corresponding reduction in passenger safety.

This distortion of the accelerometer's threshold in the event of off-axis impacts can be reduced by setting the side walls at an angle $\phi$. The effect may be summarized using the following equation:.

$$\frac{A_x}{A} = \cos\theta + (\tan\phi - \mu)\left[\frac{\sin\theta\cos\phi - \sin\phi\cos\theta}{(1+\tan^2\phi)\cos\phi}\right]$$

Thus, if an accelerometer is provided with a passage having an eight degree side-wall angle and a coefficient of sliding friction $\mu$ of 0.20, the application of an acceleration input A at a relative impact angle $\theta$ of thirty degrees produces an accelerating force $A_x$ on the sensing mass which is approximately 84.4 percent of the applied acceleration input A—a substantial improvement over the 76.6 percent figure calculated above with respect to parallel-walled accelerometers. Indeed, evaluation of the above equation indicates that the percent increase in transmitted acceleration from off-axis impacts is roughly equal to the side-wall angle $\phi$ in degrees.

Accordingly, the prior art teaches accelerometers having angled side walls to accommodate off-axis impacts. For example, U.S. Pat. No. 3,774,128 to Orlando teaches an accelerometer featuring a ball-shaped sensing mass which travels within a horizontally-flared passage, i.e., within a passage having diverging side walls, in response to an acceleration input directed within the included angles of the passage's side walls. Specifically, the ball-shaped sensing mass is biased to a "ball seat" or rest position within the passage by a permanent magnet. An planar ferritic exterior bracket provides a suitable flux path for the magnetic return bias while further exerting a downward bias on the sensing mass to limit bouncing.

Unfortunately, however, the use of angled side walls in an accelerometer is not a panacea: while such accelerometers suffer from less distortion of their firing thresholds in the event of off-axis impacts, accelerometers such as the one taught by Orlando must necessarily be characterized as being of the nonintegrating type, inasmuch as they lack sufficient means for damping the movement of the sensing mass within the passage due to its changing cross-sectional dimensions. Moreover, where such accelerometers employ a magnetic return bias, as the side wall angle increases, increasingly complex magnetic circuits are required to ensure useful force-versus-displacement curves for all included angles, with an ultimate limit as to side wall angle $\phi$. Still further, the use of angled side walls presents problems relating to contact design and achievable contact dwell, particularly where multiple circuit contacts are desired; and the additional degree of freedom (yaw) can be a disadvantage in controlling system dynamics and the contacts interface. Finally, known accelerometers having angled side walls are more difficult to manufacture than their parallel-walled counterparts.

Therefore, what is desired is an integrating accelerometer having angled side walls and featuring nearly identical return-bias-force-versus-displacement curves for sensing mass displacement along all included angles, increased contact dwell, and multiple circuit capability, as well as featuring improved testability and reconfigurability functions.

SUMMARY OF THE INVENTION

It is an object of the invention to provide an integrating or "damped" accelerometer which features a horizontally-flared passage, i.e., angled side walls, for increased reliability in the event of off-axis impacts.

Another object of the invention is to provide a damped accelerometer having angled side walls and featuring a nearly identical return bias force for a given amount of sensing mass displacement along each included angle.

Another object of the invention is to provide a damped accelerometer featuring angled side walls at a greater side wall angle $\phi$ than has heretofore been possible, given the constraints inherent to known designs.

Another object of the invention is to provide an accelerometer capable of sensing off-axis impacts which features displacement-varying velocity-based damping, whereby contact dwell is improved.

Another object of the invention is to provide an accelerometer capable of sensing off-axis impacts which features multiple circuit closure using but a single sensing mass.

Another object of the invention is to provide a testable integrating accelerometer capable of sensing off-axis impacts.

Yet another object of the invention is to provide an integrating accelerometer capable of sensing off-axis impacts featuring a magnetic return bias which may be selectively increased so as to reconfigure the accelerometer as one employing a higher level of crash discrimination.

Yet another object of the invention is to provide an integrating accelerometer having angled side walls and featuring ease of manufacture.

Under the invention, an accelerometer comprises a housing having a horizontally-flared passage defined therein about a central longitudinal axis, that is, a passage of preferably rectangular cross-section having a substantially planar, horizontal basal surface and a pair of vertical side walls, wherein at least one of the side walls forms a divergent angle with the central axis such that the distance between the side walls increases with increasing displacement along the central axis from a first end of the passage towards a second end thereof. The accelerometer further includes a first magnetically-permeable element secured to the housing proximate to the first end of the passage and, preferably, a second identical magnetically-permeable element secured to the housing so as to be diametrically positioned thereon relative to the passage, with the first positioned above the passage and the second positioned below it. A magnetic sensing mass located within the passage magnetically interacts with the magnetically-permeable element(s) so as to be magnetically biased towards a first position in the first end of the passage, with the sensing mass moving from its first position in the passage in response to application of an accelerating force to the housing which exceeds the magnetic bias thereon. A switch means on the housing is responsive to displacement of said sensing mass within the passage, as where an electrically-conductive surface on the sensing mass bridges a pair of beam contacts projecting into the passage when the sensing mass moves from its first position in the passage towards a second position therein.

The accelerometer further includes means for damping the movement of the sensing mass within the passage. Specifically, the accelerometer includes a first electrically-conductive magnetically-nonpermeable element, such as a copper plate, secured to the housing proximate to the passage and, preferably, a second identical plate secured to the housing so as to be diametrically positioned thereon relative to the passage, with the first positioned above the passage and the second positioned below it. In this regard, it is preferable that the damping plates be nested within the magnetically-permeable elements so as to expose the plate to the greater magnetic flux density. Movement of the magnetic sensing mass within the passage generates eddy currents in the plates which in turn generate a secondary magnetic field resisting further movement of the sensing mass.

Under the invention, the magnetic axis of the sensing mass extends in a direction normal to its plane of motion within the passage, i.e., its magnetic axis extends in a direction normal to the passage's basal surface. The vertical orientation of the magnetic axis of the sensing mass ensures that, with proper choice of the material and dimensions of the magnetically-permeable elements, a nearly identical return-bias-force-versus-distance curve may be obtained for sensing mass displacement away from its first position along each and every included angle between the side walls and, indeed, greater side wall angles $\phi$ may be employed without disturbing the desired force-versus-displacement curve of the magnetic return bias exerted on the sensing mass. And, where a pair of magnetically-permeable elements are used, a symmetrical return bias is applied to the sensing mass through each of its magnetic poles. Moreover, by directly opposing the magnetic poles and the damping plates, the resulting increase in flux density through the adjacent damping plates provides for quantitatively greater damping effect. And, in accordance with another feature of the invention, the width dimension of each damping plate increases as it extends in a direction generally parallel to the accelerometer's central axis, thereby providing an increased damping effect with increased sensing mass displacement in the passage which, in turn, improves contact dwell.

In a preferred embodiment, the sensing mass is formed in the shape of a puck, that is, a longitudinal section of a right circular cylinder, with its magnetic axis aligned with its central axis. This shape allows for multiple-circuit switch means for sensing movement of the sensing mass within the passage, as through the use of axially-spaced electrically-conductive circumferential surfaces on the sensing mass which bridge discrete pairs of beam contacts projecting into the passage. Greater versatility in contact packaging is yet another feature provided by the puck's cylindrical, as opposed to mere spherical or planar, contact surface. For example, the pairs of beam contacts may be bridged by the sensing mass either when its assumes its first position in the passage or when it is displaced to its second position in the passage by an acceleration input to the housing.

In accordance with another feature of the invention, the accelerometer is provided with a means for electro-magnetically displacing the sensing mass away from its first position in the passage, whereby the operability of the accelerometer's switch means may be periodically tested. In a preferred embodiment, the means for electromagnetically displacing the sensing mass from its first position includes a first vertically-wound coil mounted on the housing so as to be positioned generally above the passage, and a second vertically-wound coil mounted on the housing so as to be positioned generally below the passage, with the second coil being wound in the same direction as the first coil. Each coil is preferably oblong and secured to the housing so that its major axis extends in a direction substantially parallel to the central axis of the accelerometer, thereby extending the power stroke of the coil. Moreover, each of the magnetically-permeable elements used to provide a return bias on the sensing mass is preferably contoured and otherwise positioned relative to a respective test coil so as to form a portion of magnetic circuit of the coil to improve its efficiency. Upon energizing the test coil, the resultant magnetic field overcomes the magnetic return bias to displace the sensing mass to its second position in the passage.

In accordance with another feature of the invention, the current directed through the test coils is reversed so as to increasingly magnetically bias the sensing mass towards its first position in the passage, whereby the triggering threshold of the accelerometer is increased and the accelerometer "reconfigured" as for purposes of maximizing the effectiveness of a passenger safety restraint controlled therewith.

BRIEF DESCRIPTION OF THE DRAWINGS

FIG. 1 is a longitudinal view in cross-section of an improved accelerometer in accordance with the invention showing the magnetic sensing mass thereof in its first or "rest" position within the passage; and FIG. 2 is a cross-sectional view of the accelerometer along line 2—2 of FIG. 1, looking along the central axis of the accelerometer, past the contacts and into the flared end of the passage;

FIG. 3 is a cross-sectional view of the accelerometer along line 3—3 of FIG. 1 showing the passage with its angled side walls, and the polygonal cut of the damping plates as they extend parallel to the central axis of the accelerometer; and FIG. 4 is an exploded side view of the puck-shaped magnetic sensing mass used in the disclosed preferred embodiment of the accelerometer of the invention.

DETAILED DESCRIPTION OF THE PREFERRED EMBODIMENT

Referring to FIG. 1 of the drawings, an exemplary embodiment 10 of the accelerometer of the invention a housing 12 having a horizontally-flared internal passage 14 of generally rectangular cross-section defined about a central longitudinal axis 16. Specifically, the passage 14 has a substantially planar, horizontal basal surface 18 and a pair of vertical side walls 20, with each side wall 20 forming a divergent angle $\phi$ with the accelerometer's central longitudinal axis 16. The use of angled side walls 20 reduces the likelihood of deleterious frictional contact with a side wall 20 in the event of an "off-axis" acceleration input to the accelerometer 10 along any "included angle" between the two side walls 20.

The accelerometer 10 further includes identical first and second magnetically-permeable elements 22 secured to the housing 12 proximate to the first end 24 of the passage 14 so as to be diametrically positioned thereon relative to the passage 14, with the first magnetically-permeable element 22 being positioned above the passage 14 and the second magnetically-permeable element 22 being positioned below the passage 14.

A magnetic sensing mass 26 located within the passage 14 magnetically interacts with each of the magnetically-permeable elements 22 so as to be magnetically biased towards a first position in the first end 24 of the passage 14, with the sensing mass 26 moving from its first or "rest" position towards a second position in the passage 14 in response to application of an accelerating force to the housing 12 which exceeds the magnetic bias thereon.

In the preferred embodiment 10, the sensing mass 26 is formed in the shape of a puck, that is, a longitudinal section of a right circular cylinder. And, the preferred embodiment 10 advantageously features a multiple-circuit switch means on the housing 12 which is responsive to displacement of the sensing mass 26 within the passage 14 away from its first position therein. Specifically, the puck-shaped sensing mass 26 is provided with a pair of axially-spaced electrically-conductive circumferential surfaces 28 on the sides thereof which engage two discrete pairs of beam contacts 30 projecting into the passage 14 when the sensing mass 26 moves from its first position in the passage 14 to its second position therein, as best seem in FIG. 2.

In accordance with the invention, the magnetic axis of the sensing mass 26 extends in a direction normal to its plane of motion within the passage 14, i.e., its magnetic axis extends in a direction normal to the passage's basal surface 18. Thus, for the puck-shaped sensing mass 26 of the preferred embodiment, the magnetic axis of the sensing mass 26 is aligned with its central longitudinal axis. The vertical orientation of the magnetic axis of the sensing mass 26 ensures that, with proper choice of the material and dimensions of the magnetically-permeable elements 22, a nearly identical return-bias-force-versus-distance versus-distance curve may be obtained for sensing mass displacement away from its first position along each and every included angle between the side walls 20. The vertical orientation of magnetic axis further provides for the generation of a vertically-symmetrical return bias on the sensing mass 26 through the interaction of each of its magnetic poles with the magnetically-permeable elements 22, respectively. And the vertical orientation of the magnetic axis ensures a constant return bias upon pure rotation of the sensing mass 26 within the passage 14.

The preferred embodiment 10 of the accelerometer further includes means for damping the movement of the sensing mass 26 within the passage 14. Specifically, identical first and second electrically-conductive magnetically-nonpermeable plates 32 are secured to the housing 12 proximate to the passage 14. In the preferred embodiment 10 shown in the drawings, the first and second damping plates 32 are secured to the housing 12 so as to be diametrically positioned thereon relative to the passage 14, with the first plate 32 being positioned above the passage 14 and the second plate 32 being positioned below the passage 14. In this regard, it is preferable that the damping plates 32 be nested within the magnetically-permeable elements so as to expose the plate to the greater magnetic flux density. Indeed, as noted in the drawings, the first and second plates 32 may themselves perform the additional function of defining the basal surface 18 and upper surface 34 of the passage 14, respectively, whereby manufacture of the accelerometer 10 is greatly simplified and permitting greater flexibility in switch contact design.

In operation, the movement of the magnetic sensing mass 26 within the passage 14 generates eddy currents in the plates 32 which in turn generate a secondary magnetic field resisting further movement of the sensing mass 26 that is proportional to its relative temporal velocity. The resulting dynamic breaking effect damps the motion of the sensing mass 26 to provide "integration" of the acceleration input over time. And, under the invention, the direct opposition of the magnetic poles and the damping plates 32 due to the vertical orientation of the magnetic axis of the sensing mass 26 provides a qualitatively greater damping effect than has heretofore been experienced with known designs. Preferably, the width dimension of each damping plate 32 increases as it extends in a direction generally parallel to the accelerometer's central longitudinal axis 16, thereby providing an increased damping effect with increased sensing mass displacement in the passage 14 which, in turn, improves contact dwell. A preferred polygonal shape for each damping plate 32 may be readily seen in FIG. 3.

In accordance with another feature of the invention, the preferred embodiment 10 of the accelerometer is provided with a means for electromagnetically displacing the sensing mass 26 away from its first position in the passage 14, whereby the operability of the accelerometer's switch means may be periodically tested. Specifically, a first vertically-wound coil 36 is mounted on the housing 12 so as to be positioned generally above the passage 14, and a second identical vertically-wound coil 38 is mounted on the housing 12 so as to be positioned generally below the passage 14, with the second coil 38 being wound in the same direction as the first coil 36. Each coil 36,38 is preferably oblong and secured to the housing 12 so that its major axis extends in a direction substantially parallel to the central longitudinal axis of the accelerometer 10, thereby extending the power stroke of each coil 36,38. And, preferably, each of the magnetically-permeable elements 22 used to provide a return bias on the sensing mass 26 is contoured and otherwise positioned relative to a respective test coil 36,38 so as to form a portion of the coil's magnetic circuit, thereby improving its efficiency. Upon energizing the test coil 36,38, the resultant magnetic field overcomes the magnetic return bias to displace the sensing mass 26 to its second position in the passage 14.

In accordance with another feature of the invention, the current directed through the test coils 36,38 is reversed so as to increasingly magnetically bias the sensing mass 26 towards its first position in the passage 14, whereby the accelerometer's triggering threshold is increased and the accelerometer 10 is "reconfigured" as for purposes of maximizing the effectiveness of a passenger safety restraint controlled therewith (not shown).

As noted above, the puck-shaped sensing mass 26 used in the preferred embodiment is provided with two axially-spaced conductive surfaces 28 about the circumference thereof for bridging two discrete pairs of beam contacts 30 projecting into the passage 14. FIG. 4 shows an exploded side view of a preferred constructed embodiment of the sensing mass 26, specifically comprising an insulative top cap 40, a first conductive sleeve 42 providing the first circumferential conductive surface 28, a cylindrical magnet 44 having a vertical magnetic axis, an annular electrical insulator 46, a second conductive sleeve 48 providing the second conductive surface 28, and an insulative bottom cap 50. The caps 40,50, which snap together for ease of assembly, are preferably manufactured as from an injection molded, low friction material such as nylon 6/6 with 18 percent PTFE and 2 percent silicone, thereby to reduce the static and dynamic effects of friction on the sensing mass 26.

Finally, it is noted that the invention contemplates the cooperative design of the sensing mass 26, the magnetically-permeable elements 22, and/or the first end 24 of the passage 14 so as to facilitate return of the sensing mass 26 to a nominal orientation when biased to its first position within the passage 14, as might be achieved, for example, through eccentric placement of the magnetic axis of the sensing mass 26 within the right-circular-cylindrical section defining its puck-like shape.

While the preferred embodiment of the invention has been disclosed, it should be appreciated that the invention is susceptible of modification without departing from the spirit of the invention or the scope of the subjoined claims.

We claim:

1. An integrating accelerometer comprising:

a housing having an internal passage defined therein about a first axis, said passage having a substantially planar basal surface and a pair of side walls, wherein at least one of the side walls forms a divergent angle with said first axis such that the distance between the side walls increases with increasing displacement along said first axis from a first end of said passage towards a second end of said passage; at least one magnetically-permeable biasing element secured to said housing proximate to said passage;

a magnetic sensing mass located within said passage such that the magnetic axis thereof extends in a first direction generally normal to the basal surface of said passage, said sensing mass magnetically-interacting with said biasing element so as to be magnetically biased towards a first position in the first end of said passage, said sensing mass moving from said first position in response to application of an accelerating force to said housing which exceeds said magnetic bias;

means for damping the movement of said sensing mass within said passage, said damping means including at least one electrically-conductive magnetically-nonpermeable damping element secured to said housing proximate to said passage, and wherein movement of said sensing mass within said housing generates eddy currents in said damping element; and switch means on said housing responsive to displacement of said sensing mass within said passage.

2. The accelerometer of claim 1, wherein said passage is generally of rectangular cross-section, with the side walls being substantially perpendicular to the basal surface.

3. The accelerometer of claim 1, wherein said switch means includes a first pair of contacts projecting into said passage and a first electrically-conductive surface on said sensing mass which engages said first pair of contacts when said sensing mass is displaced to a second position in said passage.

4. The accelerometer of claim 3, wherein said switch means includes a second pair of contacts projecting into said passage and a second electrically-conductive surface on said sensing mass which engages said second pair of contacts when said sensing mass is displaced to said second position in said passage.

5. The accelerometer of claim 1, wherein said at least one biasing element extends in a direction generally parallel to said first axis.

6. The accelerometer of claim 1, wherein said at least one damping element comprises a plate secured to said housing in parallel relation with the basal surface of said passage.

7. The accelerometer of claim 6, wherein a portion of said plate extends in a direction generally parallel to said first axis, and wherein a width dimension of the extending portion of said plate varies with increasing displacement along said first axis from the first end of said passage towards the second end of said passage.

8. The accelerometer of claim 1, including means for electromagnetically displacing said sensing mass from said first position so as to operate said switch means without regard to acceleration inputs to said housing.

9. The accelerometer of claim 8, wherein said means for electromagnetically displacing said sensing mass includes a first coil mounted on said housing, said first coil being wound about a second axis extending in a direction generally normal to the basal surface of the passage.

10. The accelerometer of claim 9, wherein said first coil is oblong so as to have a major axis, with the major axis of said first coil extending generally parallel to said first axis.

11. The accelerometer of claim 9, wherein said means for electromagnetically displacing said sensing mass further includes a second coil mounted on said housing so as to be diametrically opposite said first coil relative to said passage, said second coil being wound about said second axis in the same direction as said first coil.

12. The accelerometer of claim 8, wherein said at least one biasing element forms a portion of the magnetic circuit of said electromagnetic displacement means.

13. The accelerometer of claim 8, wherein said electromagnetic displacement means further operates to increasingly bias said sensing mass towards said first position in said passage.

14. In an accelerometer comprising:

a housing having an internal passage formed therein about a first axis; at least one magnetically-permeable biasing element secured to said housing proximate to said passage;

a magnetic sensing mass located within said passage, said sensing mass having a magnetic axis extending between a first magnetic pole and a second magnetic pole, said sensing mass magnetically-interacting with said biasing element so as to be magnetically biased towards a first position in said passage, said sensing mass moving from said first position in said passage in response to application of an accelerating force to said housing which exceeds said magnetic bias;

at least one electrically-conductive magnetically-nonpermeable damping element secured to said housing proximate to said passage, wherein movement of said sensing mass within said housing generates eddy currents in said damping element to damp the movement of said sensing mass within said passage; and switch means on said housing responsive to displacement of said sensing mass within said passage, the improvement wherein:

said passage has a substantially planar basal surface and a pair of side walls, at least one of the side walls forming a divergent angle such that the distance between the side walls increases with increasing displacement along said first axis as said sensing mass is displaced from said first position; and the magnetic axis of said sensing mass extends in a direction generally normal to the basal surface of said passage.

15. The accelerometer of claim 14, wherein said passage is generally of rectangular cross-section, with the side walls being substantially perpendicular to the basal surface; and wherein said at least one damping element comprises a plate secured to said housing in parallel relation with the basal surface of said passage.

16. The accelerometer of claim 15, wherein a portion of said plate extends generally parallel to said first axis, and wherein a width dimension of the extending portion of said plate varies with increasing displacement along said first axis away from said first position in said passage.

17. The accelerometer of claim 14, wherein said sensing mass is puck-shaped, and wherein said switch means includes two discrete pairs of contacts projecting into said passage and a pair of discrete electrically-conductive circumferential surfaces on said sensing mass which respectively engage said two pairs of contacts when said sensing mass is displaced to a second position in said passage.

18. The accelerometer of claim 14, including means for electromagnetically displacing said sensing mass from said first position so as to operate said switch means without regard to acceleration inputs to said housing.

19. The accelerometer of claim 18, wherein said electromagnetic displacement means further operates to increasingly bias said sensing mass towards said first position in said passage.

20. The accelerometer of claim 14, wherein said at least one biasing element forms a portion of the magnetic circuit of said electromagnetic displacement means.

21. An integrating accelerometer comprising:

a housing having an internal passage defined therein about a first axis, said passage having a substantially planar basal surface and a pair of side walls, wherein at least one of the side walls forms a divergent angle with said first axis such that the distance between the side walls increases with increasing displacement along said first axis from a first end of said passage towards a second end of said passage; at least one magnetically-permeable biasing element secured to said housing proximate to said passage;

a puck-shaped magnetic sensing mass located within said passage such that the magnetic axis thereof extends in a first direction generally normal to the basal surface of said passage, said sensing mass magnetically-interacting with said at least one biasing element so as to be magnetically biased towards a first position in the first end of said passage, said sensing mass moving from said first position in response to application of an accelerating force to said housing which exceeds said magnetic bias; means for damping the movement of said sensing mass within said passage, said damping means including at least one damping electrically-conductive magnetically-nonpermeable element secured to said housing proximate to said passage, and wherein movement of said sensing mass within said housing generates eddy currents in said at least one damping element; and switch means on said housing responsive to displacement of said sensing mass within said passage.

* * * * *